US007513640B2

(12) United States Patent
Hendrikus

(10) Patent No.: US 7,513,640 B2
(45) Date of Patent: Apr. 7, 2009

(54) LIGHT TUBE SYSTEM

(75) Inventor: Westerveld Johannes Hendrikus, Sedona, AZ (US)

(73) Assignee: Omnilux Lighting, LLC., Sedona, AZ (US)

( * ) Notice: Subject to any disclaimer, the term of this patent is extended or adjusted under 35 U.S.C. 154(b) by 65 days.

(21) Appl. No.: 11/307,238

(22) Filed: Jan. 27, 2006

(65) Prior Publication Data

US 2006/0291235 A1 Dec. 28, 2006

(30) Foreign Application Priority Data

Jun. 14, 2005 (TW) ..... 94209951 U

(51) Int. Cl.
*F21V 19/02* (2006.01)

(52) U.S. Cl. ..... 362/219; 362/224; 362/225

(58) Field of Classification Search ..... 362/217, 362/219–620, 640, 647, 651–652, 657–659; 439/290, 378–381
See application file for complete search history.

(56) References Cited

U.S. PATENT DOCUMENTS

| | | | | |
|---|---|---|---|---|
| 4,092,562 | A | 5/1978 | Campbell | 315/189 |
| 5,357,412 | A * | 10/1994 | Entrop et al. | 362/219 |
| 5,521,805 | A * | 5/1996 | Lim | 362/221 |
| 5,565,728 | A * | 10/1996 | Jung | 313/51 |
| 5,658,067 | A | 8/1997 | Engle et al. | 362/222 |
| 5,702,176 | A | 12/1997 | Engle | 362/219 |
| 5,906,427 | A | 5/1999 | Noh | 362/223 |
| 6,536,924 | B2 | 3/2003 | Segretto | 362/345 |
| 6,670,626 | B2 | 12/2003 | Witham et al. | 250/504 R |
| 6,964,495 | B2 | 11/2005 | Schnaufer et al. | 362/378 |
| 6,964,504 | B2 | 11/2005 | Newbold | 362/375 |
| 2002/0118537 | A1 | 8/2002 | Segretto | 362/226 |
| 2003/0021110 | A1 * | 1/2003 | Noh | 362/217 |
| 2005/0020133 | A1 | 1/2005 | Homann et al. | 439/606 |
| 2006/0007682 | A1 | 1/2006 | Reiff et al. | 362/253 |
| 2006/0039168 | A1 * | 2/2006 | Mier-Langner et al. | 362/648 |
| 2008/0165530 | A1 | 7/2008 | Hendrikus | 362/227 |

OTHER PUBLICATIONS

Taiwanese Patent Publication No. 274354, Apr. 11, 1996, 4 pages.

* cited by examiner

*Primary Examiner*—Anabel M Ton
*Assistant Examiner*—Julie A Shallenberger
(74) *Attorney, Agent, or Firm*—Alan Kamrath; Kamrath & Associates PA

(57) ABSTRACT

A light tube holder includes two internal sockets, an external socket and a plug. The internal sockets of the light tube holder can receive two pair of pins of a light tube. The external socket of the light tube holder can receive the plug of another light tube holder so that the light tube holders are connected to each other.

19 Claims, 8 Drawing Sheets

4 - 4

LIGHT TUBE SYSTEM

BACKGROUND OF INVENTION

1. Field of Invention

The present invention relates to a light tube system and, more particularly, to an assembly of a holder with a connector.

2. Related Prior Art

Disclosed in Taiwanese Patent Publication No. 274354 is a light tube system of identical units. Each of the units includes a light tube 70, a transparent tube 10, two rings 60, two plugs 50, two caps 20 and two electric blocks 30 and 40. The rings 60 are located between the light tube 70 and the transparent tube 10. The plugs 50 are fit in the ends of the transparent tube 10. Thus, the light tube 70 is firmly located in the transparent tube 10. The electric blocks 30 and 40 are electrically connected to the light tube 70. The electric blocks 30 and 40 are located in the caps 20. The caps 20 receive the ends of the transparent tube 10. Each of the caps 20 consists of two halves. Each of the caps 20 includes a plurality of rods 22. The transparent tube 10 defines a plurality of apertures 11 for receiving the rods 22. Each of the caps 20 defines a plurality of apertures 23. Each of the apertures 23 can receive a plug 81 of a transformer 80 or a plug 91 of a connector 90.

There are problems with this conventional light tube system. Firstly, its configuration is complicated for including many complicated elements. Secondly, its cost is high. Thirdly, the interconnection of the units is not firm. Fourthly, correct forming of each of the units is not ensured since the difference between the electric blocks 30 and 40 cannot be observed. Fifthly, correct interconnection of the units is not ensured because the difference between the electric blocks 30 and 40 cannot be observed.

The present invention is therefore intended to obviate or at least alleviate the problems encountered in the prior art.

SUMMARY OF INVENTION

According to the present invention, a light tube holder includes two internal sockets, an external socket and a plug. The internal sockets of the light tube holder can receive two pair of pins of a light tube. The external socket of the light tube holder can receive the plug of another light tube holder so that the light tube holders are connected to each other.

An advantage of the light tube holder of the present invention is its simple configuration.

Another advantage of the light tube holder of the present invention is its low cost.

Another advantage of the light tube holder of the present invention is that a light tube system can easily be made of a plurality of light tube holders.

Another advantage of the light tube holder of the present invention is its firm connection to the other light tube holder.

Another advantage of the light tube holder of the present invention is that the configuration of the socket is complementary to that of the plug so as to ensure its correct connection to the other light tube holder.

Other advantages and features of the present invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Referring to FIGS. 1 through 5, there is shown a light tube system including two light tube units and a connector 20 for interconnecting the light tube units according to the preferred embodiment of the present invention. Each of the light tube units includes a typical light tube that is omitted for the clarity of the drawings and a holder 10 for holding the light tube.

Figure 2:
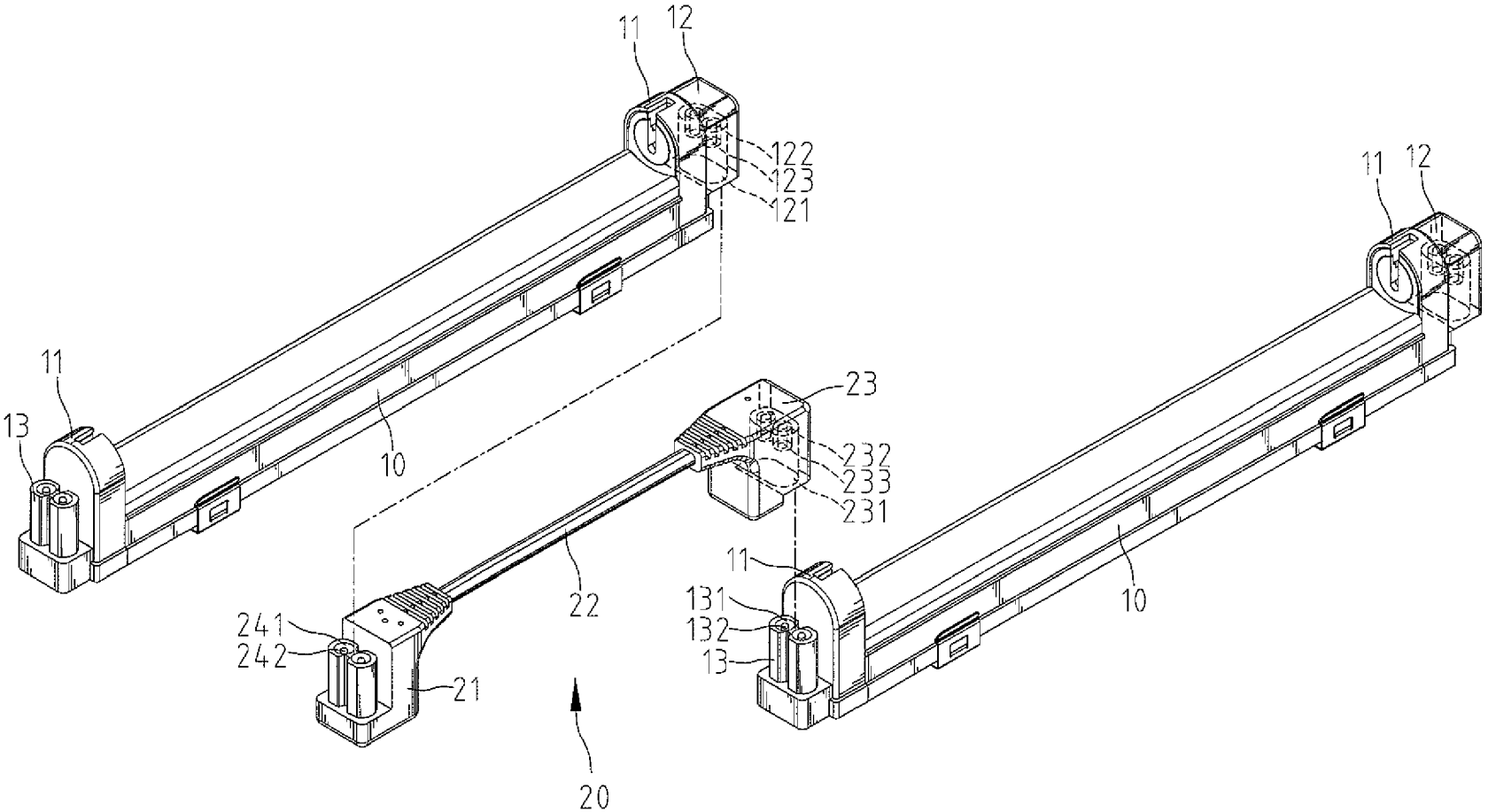
FIG. 2 is an exploded view of the light tube system shown in FIG. 1.

Referring to FIG. 2, each of the holders 10 includes two sockets 11 at two ends for receiving two pairs of pins of such a typical light tube, a socket 12 at one of the ends and a plug 13 at the other end.

The socket 12 includes a cap 121, two cylinders 122 protruding from the ceiling of the cap 121 and two receptacles 123 fit in the cylinders 122. The cap 121 and the cylinders 122 are electrically isolative while the receptacles 123 are electrically conductive.

The plug 13 includes two cylinders 131 and two pins 132 located in the cylinders 131. The cylinders 131 are electrically isolative while the pins 132 are electrically conductive.

The connector 20 includes a plug 21, a socket 23 and a cable 22 for connecting the socket 23 to the plug 21.

The plug 21 includes two cylinders 241 and two pins 242 located in the cylinders 241. The cylinders 241 are electrically isolative while the pins 242 are electrically conductive. The configuration and function of the plug 21 is like that of the plug 13.

The socket 23 includes a cap 231, two cylinders 232 protruding from the ceiling of the cap 231 and two receptacles 233 fit in the cylinders 232. The cap 231 and the cylinders 232 are electrically isolative while the receptacles 233 are electrically conductive. The configuration and function of the socket 23 is like that of the socket 12.

Figure 4:
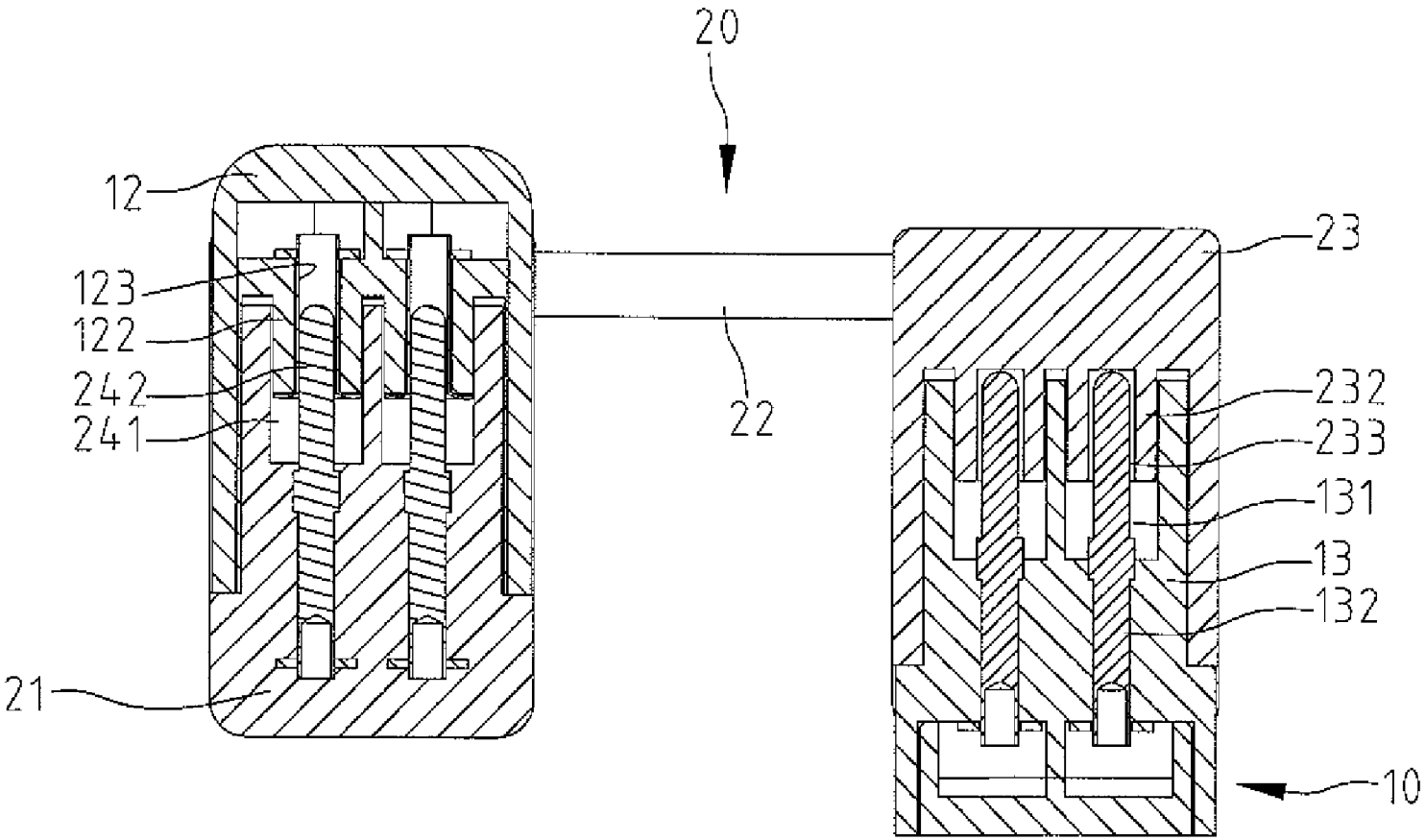
FIG. 4 is a cross-sectional view of the light tube system along a line 4-4 in FIG. 3.

Referring to FIG. 4, the receptacles 123 of one of the holders 10 receive the pins 242, and the receptacles 233 receive the pins 132 of the other holder 10. Thus, the holders 10 are electrically connected to each other by the connector 20.

The cap 121 of one of the holders 10 receives the cylinders 241 while the cylinders 241 receive the cylinders 122 of the holder 10. The cap 231 receives the cylinders 131 of the other holder 10 while the cylinders 131 of the other holder 10 receive the cylinders 232. Thus, the holders 10 are mechanically connected to each other by the connector 20.

Figure 1:
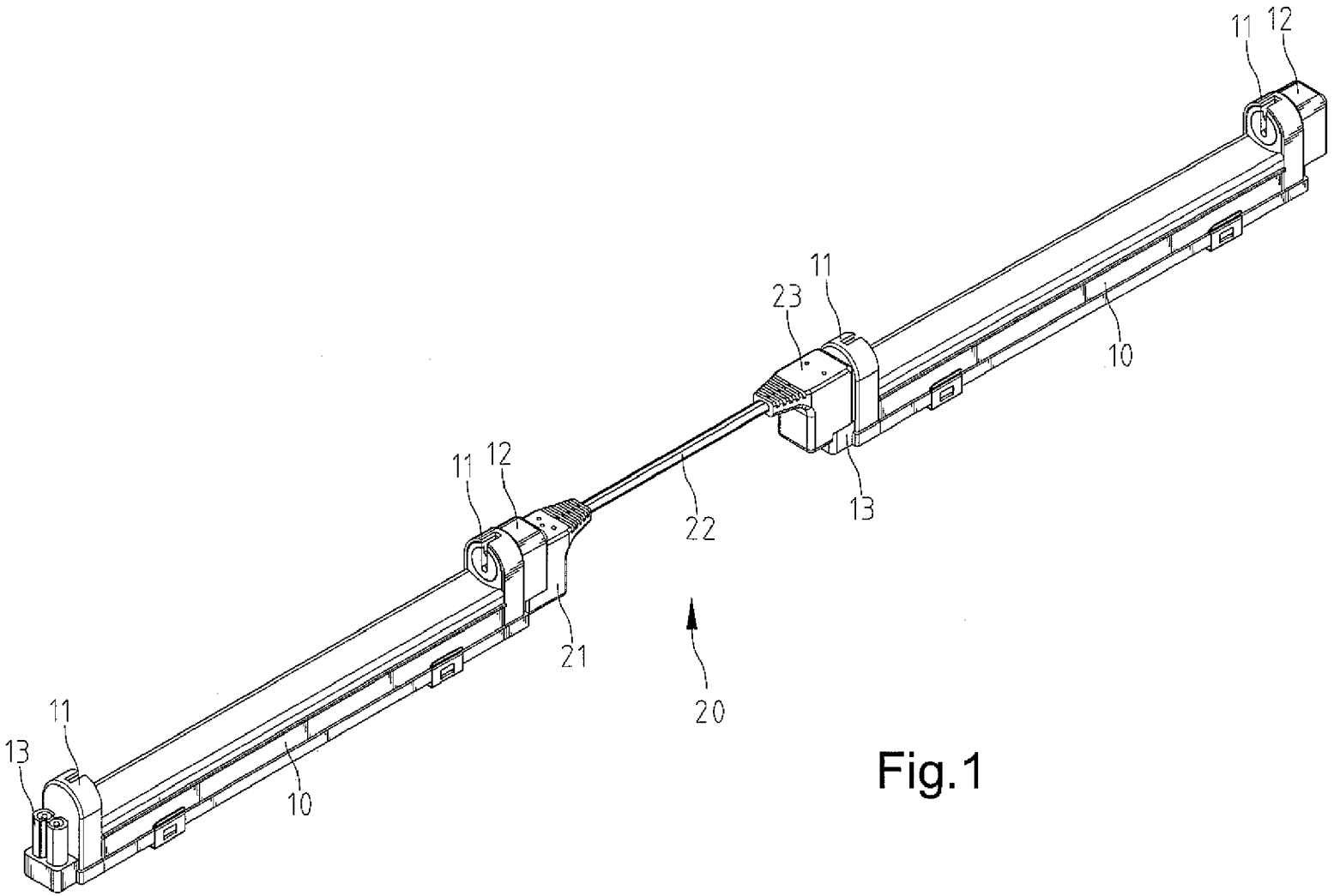
FIG. 1 is a perspective view of a light tube system including two light tube units and a connector according to the preferred embodiment of the present invention.
Figure 3:
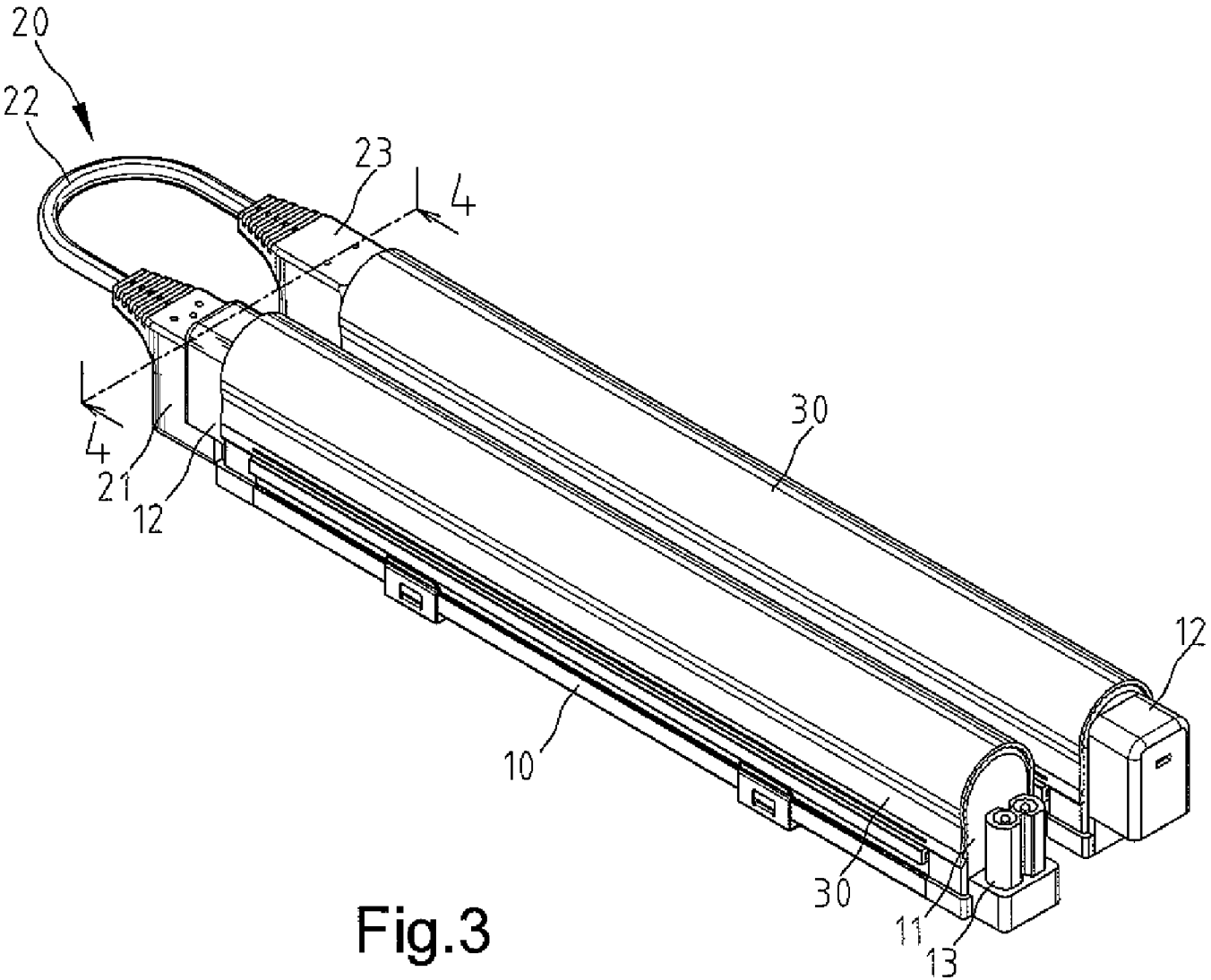
FIG. 3 is a perspective view of the light tube system in another position than shown in FIG. 1.
Figure 5:
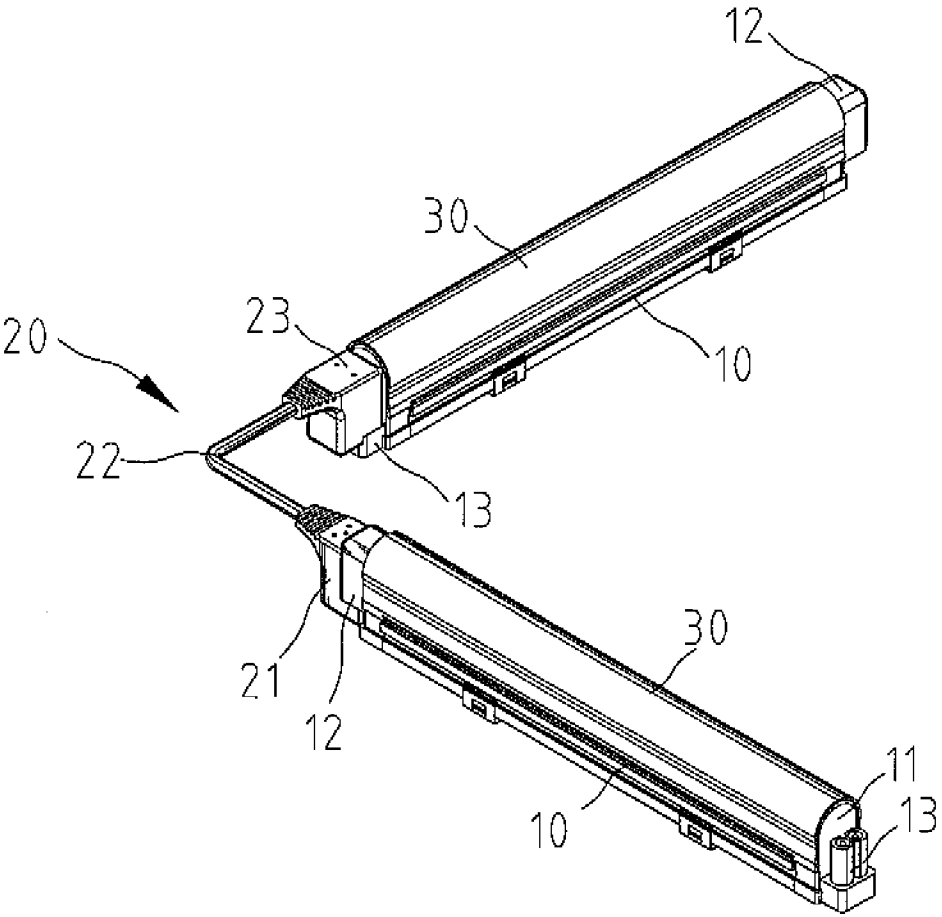
FIG. 5 is a perspective view of the light tube system in another position than shown in FIG. 3.

Referring to FIGS. 1, 3 and 5, the system can be located in various positions in various environments. Referring to FIGS. 3 and 5, such a typical light tube installed on each of the holders 10 is covered by transparent or translucent cover 30.

Figure 6:
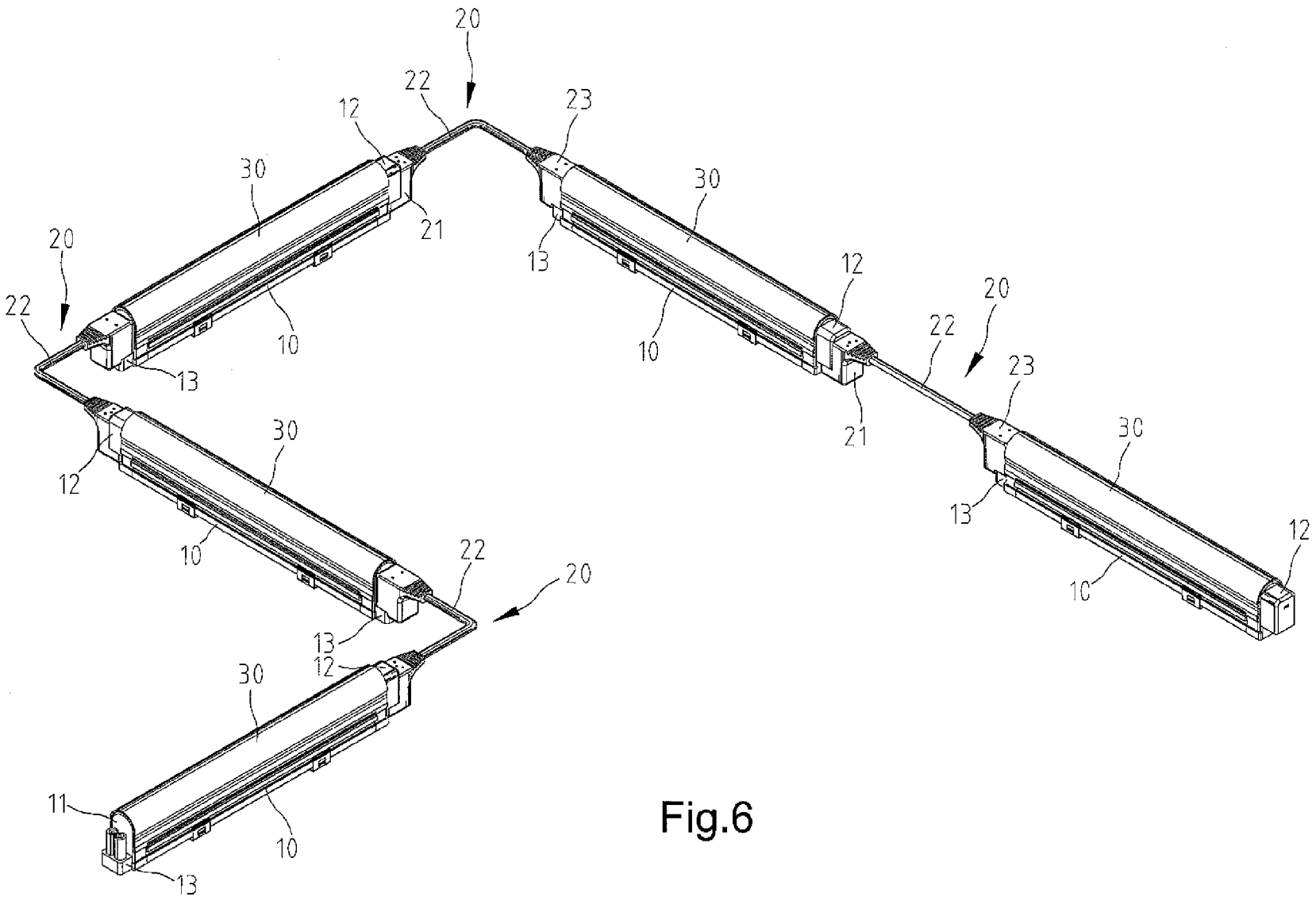
FIG. 6 is a perspective view of a light tube system including five light tube units and four connectors as shown in FIG. 1.

Referring to FIG. 6, there is shown a light tube system including five holders 10 and four connectors 20.

As described referring to FIGS. 1 through 6, according to the present invention, a light tube system includes a first number of light tube units and a second number of connectors. The second number is one less than the first number.

Figure 7:
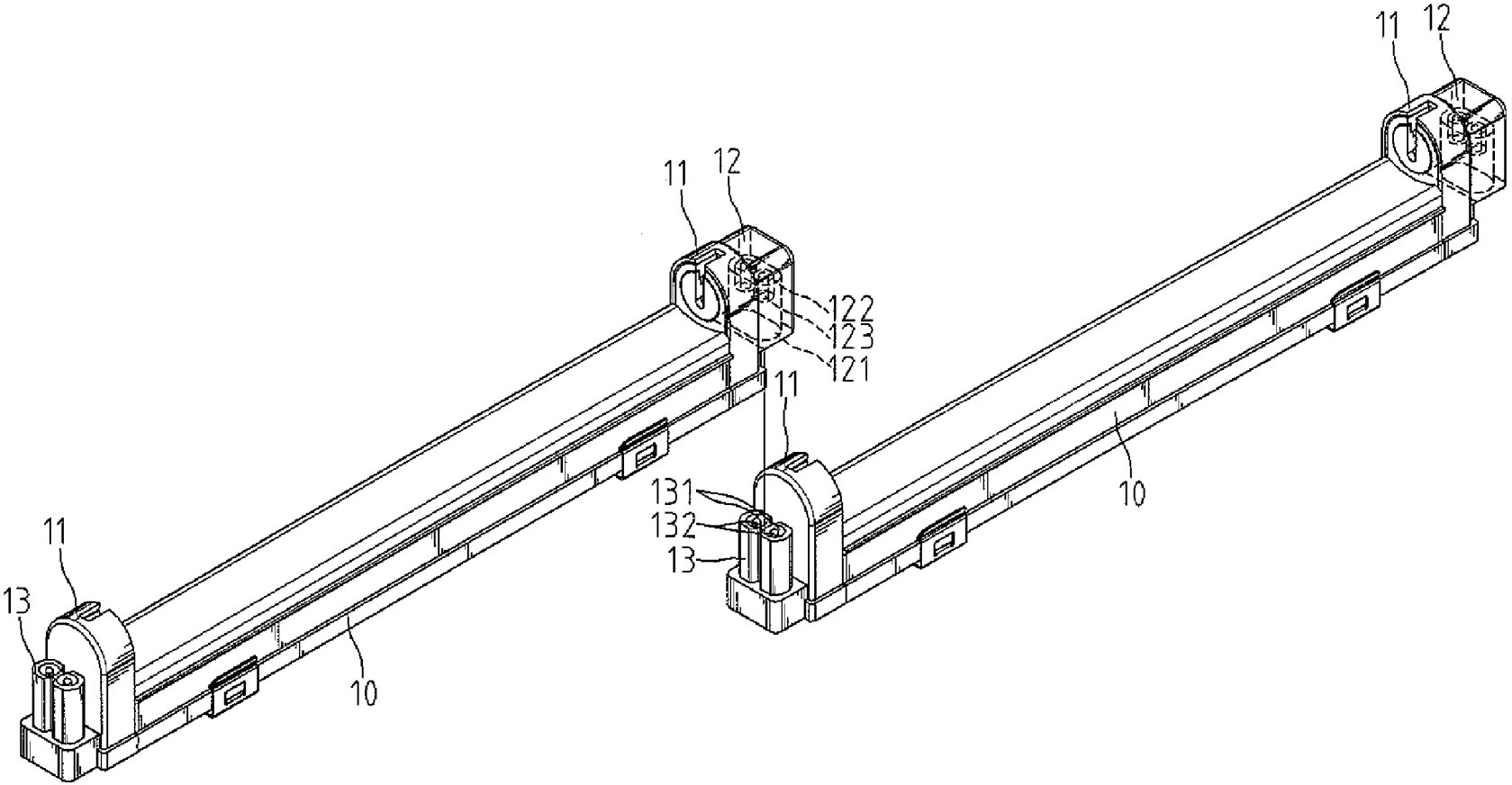
FIG. 7 is an exploded view of a light tube system including two light tube units as shown in FIG. 1.
Figure 8:
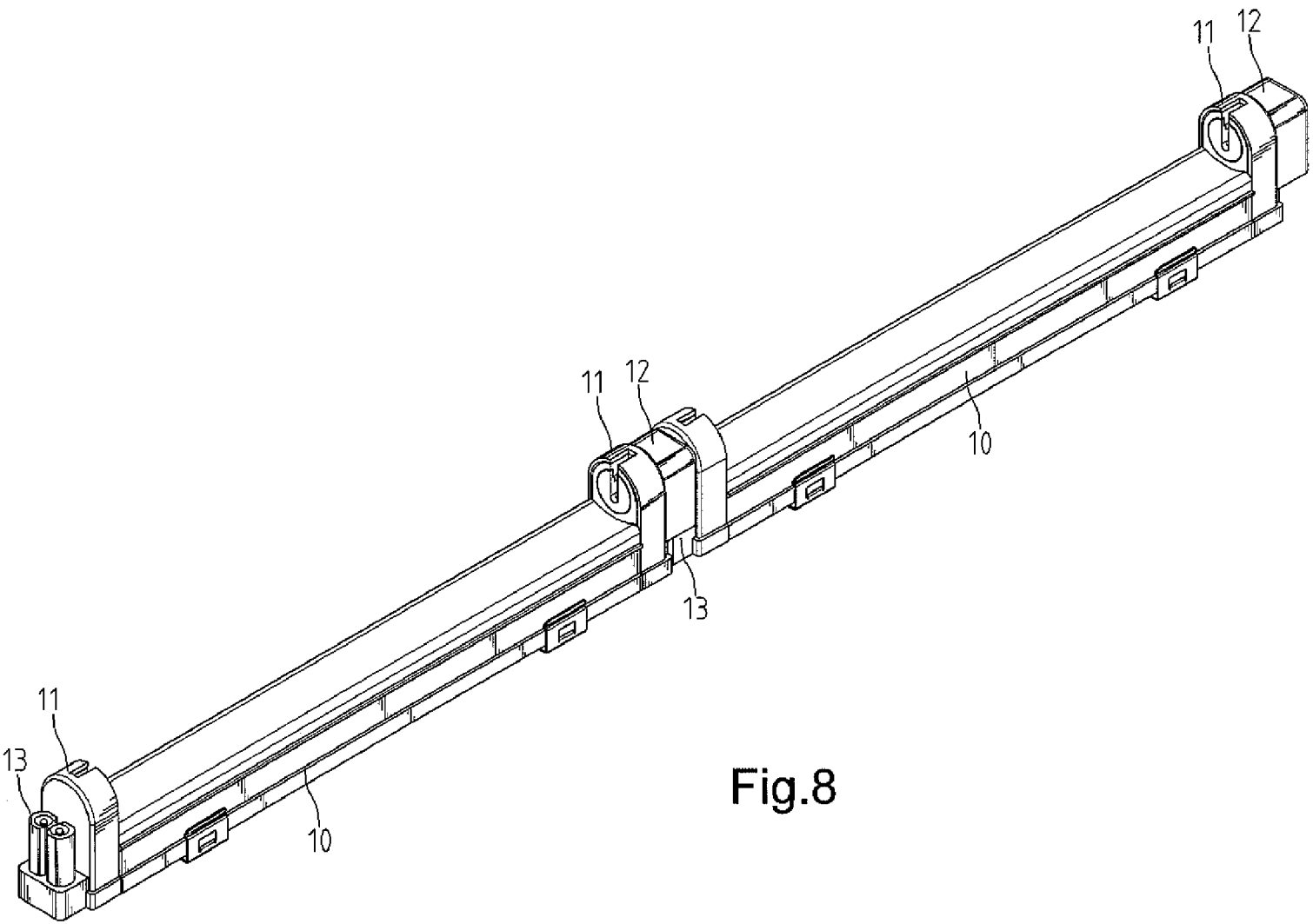
FIG. 8 is a perspective view of the light tube system shown in FIG. 7.

Referring to FIGS. 7 and 8, according to the present invention, a light tube system may include only the light tube units. The receptacles 123 of one of the holders 10 receive the pins 132 of the other holder 10 so that the holders 10 are electrically connected to each other. The cap 121 of one of the holders 10 receives the cylinders 131 of the other holder 10 while the cylinders 131 of the latter receive the cylinders 122 of the former so that the holders 10 are mechanically connected to each other.

The light tube system of the present invention exhibits a plurality of advantages. Firstly, its configuration is simple. Secondly, its cost is low. Thirdly, firm is the connection of the holders 10 to each other, with or without the use of the connectors 20. Fourthly, the configuration of the socket 12 is complementary to that of the plug 13 so as to ensure correct connection of the holders 10 to each other.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A light tube system comprising:

at least two light tube holders, with each of the at least two light tube holders having a first end and a second end opposite the first end, with each of the at least two light tube holders including two internal sockets, with a first of the two internal sockets at the first end and a second of the two internal sockets at the second end, with each of the two internal sockets respectively receiving one of two pair of light tube pins of a light tube, with an external socket at the first end and a plug at the second end, with the two internal sockets being separated in a longitudinal direction, with the plug having a base integrally extending in the longitudinal direction from the second end opposite to the second of the two internal sockets and in a non-movable manner relative to the second end, with the plug including two plug pins extending from the base in a first direction perpendicular to the longitudinal direction, with the external socket having a socket base integrally extending in the longitudinal direction from the first end opposite to the first of the two internal sockets and in a non-movable manner relative to the first end, with the base of the plug and the socket base of the external socket being parallel to each other, being spaced perpendicular to the longitudinal direction and being non-coaxial, with the external socket including two receptacles extending from the socket base in a second direction parallel and opposite to the first direction, and wherein the two plug pins of one of the at least two light tube holders are respectively connectable electrically to the two receptacles in the external socket of another of the at least two light tube holders, with the base at a first position perpendicular to the longitudinal direction, with the socket base at a second position perpendicular to the longitudinal direction and with the first position spaced from the second position.

2. The light tube system according to claim 1 wherein the external socket comprises two socket cylinders respectively around the two receptacles, wherein the plug comprises two plug cylinders respectively surrounding the two plug pins, with the two plug cylinders respectively connectable mechanically with and receiving the two socket cylinders of the external socket of the other of the at least two light tube holders, with the two socket cylinders respectively radially surrounding the two plug pins when the two pins are respectively mechanically connected to the two socket cylinders.

3. The light tube system according to claim 2 wherein the external socket of the other of the at least two light tube holders comprises a cap extending from the socket base and receiving the two plug cylinders of the plug of the one of the at least two light tube holders, with the cap slideably receiving the base of the plug when the two plug cylinders are received in the cap.

4. The light tube system according to claim 1 further comprising a cover installed on each of the at least two light tube holders.

5. The light tube system according to claim 4 wherein the cover is transparent.

6. The light tube system according to claim 4 wherein the cover is translucent.

7. A light tube system comprising:

at least two light tube holders, with each of the at least two light tube holders having a first end and a second end opposite the first end, with each of the at least two light tube holders including two internal sockets, with a first of the two internal sockets at the first end and a second of the two internal sockets at the second end, with each of the two internal sockets respectively receiving one of two pair of light tube pins of a light tube, with an external socket at the first end and a plug at the second end, with the two internal sockets being separated in a longitudinal direction, with the plug having a base integrally extending in the longitudinal direction from the second end opposite to the second of the two internal sockets and in a non-movable manner relative to the second end, with the plug including two plug pins extending from the base in a first direction perpendicular to the longitudinal direction, with the external socket having a socket base integrally extending in the longitudinal direction from the first end opposite to the first of the two internal sockets and in a non-movable manner relative to the first end, with the base of the plug and the socket base of the external socket being parallel to each other, being spaced perpendicular to the longitudinal direction and being non-coaxial, with the external socket including two receptacles extending from the socket base in a second direction parallel and opposite to the first direction;

at least one connector having a first connector end and a second connector end opposite the first connector end, with a connector external socket at the first connector end and with a connector plug at the second connector end, with the connector external socket having a connector socket base extending in the longitudinal direction, with the connector external socket including two connector receptacles extending from the connector socket base in the second direction, with the connector plug having a connector plug base extending in the longitudinal direction, with the connector plug having two connector plug pins extending from the connector plug base in the first direction;

wherein the two connector plug pins of the at least one connector are respectively connectable electrically to the two receptacles in the external socket of one of the at least two light tube holders, wherein the two plug pins of another of the at least two light tube holders are respectively electrically connectable to the two connector receptacles of the connector external socket of the at least one connector, with the base at a first position perpendicular to the longitudinal direction, with the socket base at a second position perpendicular to the longitudinal direction, with the connector plug base at the first position and with the first position spaced from the second position; and wherein a first number of light tube holders are respectively connected to a second number of connectors at the first and second connector ends, wherein the second number is one less than the first number.

8. The light tube system according to claim 7 wherein the external socket comprises two socket cylinders respectively around the two receptacles, wherein the connector plug of each of the at least one connector comprises two connector cylinders, with the two connector cylinders respectively surrounding the two connector plug pins and respectively connectable mechanically with and receiving the two socket cylinders of the external socket of the one of the at least two light tube holders, with the two socket cylinders respectively radially surrounding the two connector plug pins when the two connector plug pins are respectively mechanically connected to the two socket cylinders.

9. The light tube system according to claim 8 wherein the external socket comprises a cap extending from the base and receiving the two connector plug cylinders of the connector plug of the at least one connector, with the cap slideably receiving the connector plug base of the connector plug when the two connector plug cylinders are received in the cap.

10. The light tube system according to claim 9 wherein the connector external socket of the at least one connector comprises two connector cylinders respectively around the two connector receptacles, wherein the plug of each of the at least two light tube holders comprises two plug cylinders respectively receiving the two connector cylinders of the connector external socket of the at least one connector, with the two connector cylinders respectively radially surrounding the two plug pins when the two plug pins are respectively mechanically connected to the two connector cylinders.

11. The light tube system according to claim 10 wherein the external socket of each of the at least two light tube holders comprises a cap receiving the two connector plug cylinders of the connector plug of the at least one connector, with the cap slideably receiving the connector socket base of the connector plug when the two plug cylinders are received in the cap.

12. The light tube system according to claim 7 further comprising a cover installed on each of the at least two light tube holders.

13. The light tube system according to claim 12 wherein the cover is transparent.

14. The light tube system according to claim 12 wherein the cover is translucent.

15. The light tube system according to claim 1 wherein the external socket of the other of the at least two light tube holders comprises a cap extending from the socket base and receiving the two plug pins of the plug of the one of at least two light tube holders, with the cap slideably receiving the base of the plug when the two plug pins are received in the cap.

16. The light tube system according to claim 15 wherein the base of the plug is exposed around the two plug pins, with the cap abutting with the base, with the cap having a sidewall length extending from the socket base, with the two plug pins having a pin length extending from the base, with the sidewall length being greater than the pin length, with each of the two receptacles having a receptacle length extending from the base, with the sidewall length being greater than the receptacle length.

17. The light tube system according to claim 3 wherein the base of the plug is exposed around the two plug pins, with the cap abutting with the base, with the cap having a sidewall length extending from the socket base, with the two plug cylinders having a pin length, with the sidewall length being greater than the pin length, with each of the two receptacles having a receptacle length extending from the base, with the sidewall length being greater than the receptacle length.

18. The light tube system according to claim 9 wherein the connector plug base of the connector plug is exposed around the two connector plug pins, with the cap abutting with the connector plug base, with the cap having a sidewall length extending from the base, with each of the two connector receptacles having a receptacle length extending from the connector socket base, with the sidewall length being greater than the receptacle length, with each of the two connector plug pins having a connector plug pin length extending from the connector plug base, with the sidewall length being greater than the connector plug pin length.

19. The light tube system according to claim 11 wherein the base of the plug is exposed around the two plug pins, with the connector cap abutting with the base of the plug, with the connector cap having a connector sidewall length extending from the connector socket base, with the two connector receptacles having a connector receptacle length extending from the connector socket base, with the connector sidewall length being greater than the connector receptacle length, with each of the two plug pins having a plug pin length extending from the base, with the connector sidewall length being greater than the plug pin length.

* * * * *